United States Patent [19]

Mancini

[11] 3,936,914

[45] Feb. 10, 1976

[54] SEPARABLE FASTENER

[76] Inventor: William A. Mancini, 49 Galileo Ave., Providence, R.I. 02908

[22] Filed: Apr. 7, 1975

[21] Appl. No.: 565,759

[52] U.S. Cl. ..... 24/201 BN; 24/226

[51] Int. Cl.[2] ..... A44B 17/00; A44B 13/00

[58] Field of Search..... 24/201 R, 201 HE, 201 HH, 24/201 A, 201 BN, 75, 225, 226, 227

[56] References Cited

UNITED STATES PATENTS

| | | | |
|---|---|---|---|
| 347,094 | 8/1886 | Delpy | 24/226 |
| 506,494 | 10/1893 | Harrison | 24/75 |
| 658,115 | 9/1900 | Murray | 24/75 UX |
| 1,004,542 | 9/1911 | Nearing | 24/225 |
| 1,365,670 | 1/1921 | Ellison | 24/226 |
| 1,811,684 | 6/1931 | Cooper | 24/75 |
| 2,233,071 | 2/1941 | Bangs | 24/201 BN |
| 2,346,887 | 4/1944 | Winkler | 24/201 BN |

FOREIGN PATENTS OR APPLICATIONS

| | | | |
|---|---|---|---|
| 17,617 | 2/1915 | United Kingdom | 24/226 |

*Primary Examiner*—Donald A. Griffin
*Attorney, Agent, or Firm*—Salter & Michaelson

[57] ABSTRACT

A separable fastener for releasably connecting spaced ends of a flexible member, comprising first and second substantially flat body members, each having means at one of its ends for receiving an end of a flexible chain or the like, one of said members at its other end having a transverse upwardly extending flange and further having a centrally positioned opening adjacent to said flange and bridged thereby, said flange having centrally positioned upwardly and downwardly extending lugs thereon, and the second body member at its other end having a centrally positioned, gently curved, reversely bent tongue adapted to extend beneath said flange, upwardly throgh said opening, and then rearwardly over said flange to releasably interconnect said members, said tongue having a centrally positioned longitudinal slot therein through which the aforesaid lugs extend, whereby said body members must be positioned perpendicular to each other to permit connection or disconnection therebetween.

6 Claims, 8 Drawing Figures

SEPARABLE FASTENER

BACKGROUND AND SUMMARY OF THE INVENTION

Where it is desired to releasably interconnect spaced ends of a flexible member, such as link chain used for necklaces and the like, it is necessary that the fastening means be of small size so as not to aesthetically detract from the appearance of the article, particularly where the article has a cosmetic signifcance, such as an article of jewelry; and it is further necessary that the fastener be easily manipulatable, both to open and close, by touch or feel, since necklaces are frequently opened or closed by the wearer with the fastener located behind the wearer's neck. In addition, the fastener must be so constructed as not to become inadvertently opened so as to result in undesirable disconnection of the chain or other flexible member. The present invention is designed to achieve all of these objectives; and while primarily adaptable for use in connection with articles of jewelry, it is obviously not limited thereto; but rather the fastener of the present invention may be used in any environment where it is desired to releasably connect spaced ends of a flexible member.

In the jewelry industry, the most common separable fastener heretofore used is the so-called "spring ring" comprising a ring-like member having a spring-loaded jaw normally urged to closed position but manually openable against the action of the spring when it is desired to interconnect the end link of a chain to the ring. Due, however, to recent material shortages and increases in material prices, the conventional spring rings have not only become extremely expensive, but also have become in short supply. Another problem with the conventional spring ring is that manufacturing equipment for automatically producing and assembling such spring rings is both sophisticated and expensive.

It is therefore an object of the present invention to provide a separable fastener which may form an adequate substitute for the conventional spring ring and which lends itself to automatic and economically feasible manufacture.

Another object is the provision of a separable fastener that may be effectively made of relatively small size so as not to aesthetically detract from the article with which it is associated, particularly where such article is a jewelry product.

Another object is the provision of a separable fastener that is easily opened and closed by touch or feel, whereby the fastener may effectively be manipulated by the user while the fastener is located behind the user's neck.

Still another object is the provision of a separable fastener of the character described wherein a secure connection is achieved when the fastener is in its closed or connected condition, thus rendering it virtually impossible for the fastener to become inadvertently separated during use.

Other objects, features and advantages of the invention will become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
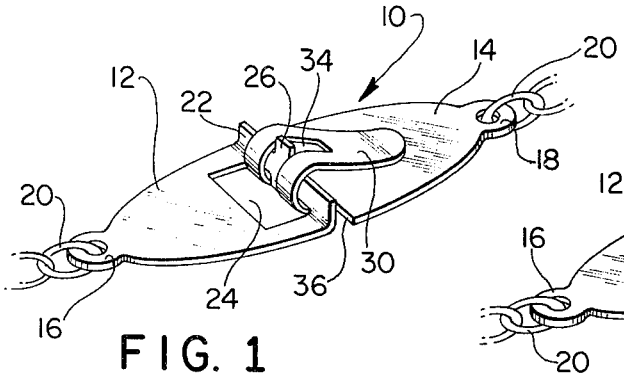
FIG. 1 is a perspective view showing the fastener of the present invention in connected relation.
Figure 2:
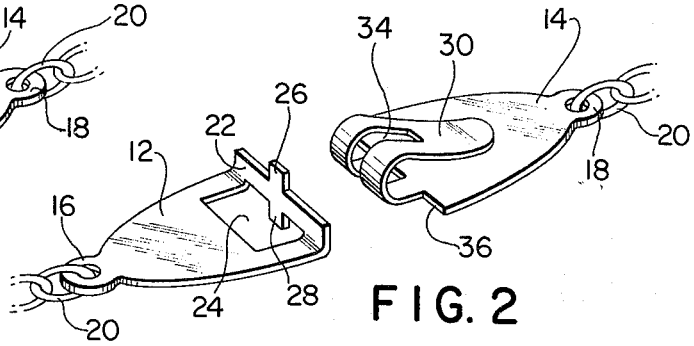
FIG. 2 is a perspective view showing the fastener in disconnected relation.

Referring now to the drawings, and more particularly to FIGS. 1 and 2, there is shown generally at 10 a separable fastener comprising a first substantially flat, plate-like body member 12 and a second similarly dimensioned and configured plate-like body member 14, both of which are preferably sheet metal stampings of any suitable metallic material, such as tempered brass or the like.

Figure 3:
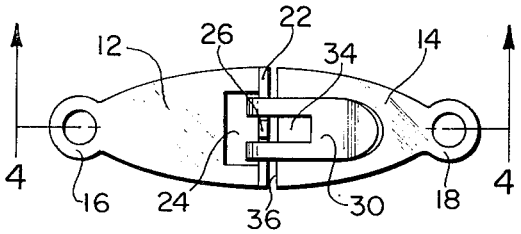
FIG. 3 is a bottom plan view of the connected fastener.
Figure 5:
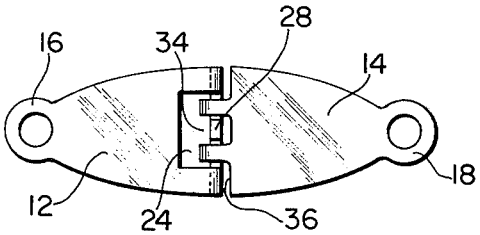
FIG. 5 is a top plan view of the connected fastener.

As will be noted, both the members 12 and 14 are gently and arcuately tapered inwardly, whereby when said members are connected, as illustrated in FIGS. 1, 3 and 5, an elongated tear-drop configuration results. At their outer ends the members 12 and 14 are each provided with integrally formed eye portions 16 and 18, respectively, which portions receive the end links of the opposite ends of a flexible chain 20, although it will be understood that the fastener 10 is not limited to connecting the ends of a link chain but rather may be utilized to releasably connect the ends of any desired flexible member.

Body member 12, at its inner end is provided with a lateral, upwardly extending, integral flange 22 that extends from side to side of said body member. Adjacent said flange the body member 12 is provided with a centrally positioned, rectangularly shaped cut-out 24, it being noted that flange 22 actually bridges said cutout. The flange 22 is provided with upwardly and downwardly extending integral lugs 26, 28, respectively, the purpose of which will hereinafter become apparent.

Figure 7:
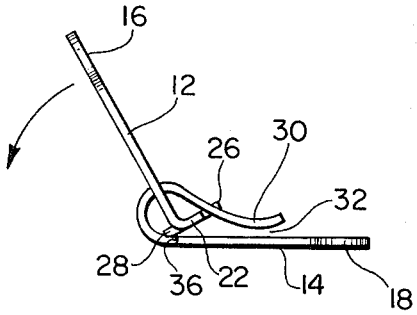

Referring now to body member 14, it will be seen that at its inner edge it is provided with an integral tongue 30 which is centrally positioned and which extends forwardly from the edge of body member 14 and then gently curves upwardly and rearwardly, terminating in closely spaced relation to the adjacent surface of body member 14, as shown most clearly in FIG. 7. The spacing 32 between the terminal portion of tongue 30 and the adjacent surface of body member 14 is just slightly less than the thickness of the metallic stock from which the members 12 and 14 are constructed. Tongue 30 is provided with a centrally positioned, longitudinally extending slot 34 which begins at the edge of body member 14 and terminates intermediate the rearwardly extending portion of tongue 30. As will be noted, the width of opening or cutout 24 is somewhat greater than the width of tongue 30 whereby the latter may extend therethrough, and, by the same token, the width of slot 34 is somewhat greater than the width of lugs 26, 28, whereby the latter may extend through said slot, in a manner hereinafter to be described.

Figure 6:
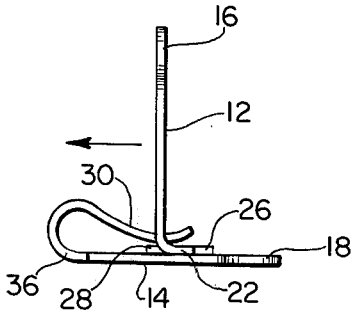
FIGS. 6 through 8 sequentially illustrate the manipulatable steps employed when connecting the two body members of the fastener.
Figure 8:
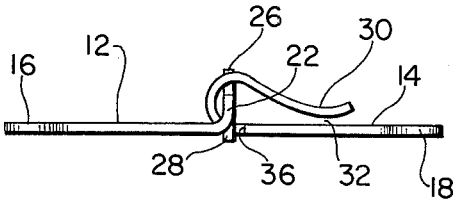

Referring to FIGS. 6 through 8, the steps for connecting the body members 12 and 14 are sequentially shown. It is first of all necessary that the body members be positioned substantially perpendicular with respect to each other, whereby flange 22 may be forced through space 32, it being understood that the resilience of tongue 30 permits this entry. After the body member 12 has been moved inwardly in the direction of the arrow in FIG. 6 until flange 22 is located within the loop of reversely bent tongue 30, the body member 12 is rotated in the direction of the arrow shown in FIG. 7 until the body members 12 and 14 lie in substantially the same plane, as illustrated in FIG. 8. In this position, the lugs 26, 28 extend through the upper and lower portions of slot 34, since the distance between the edges of lugs 26 and 28 is substantially equal to or slightly greater than the maximum height of the loop portion of tongue 30. In order to disconnect the members 12 and 14, it is necessary that the just-described procedure be reversed.

Figure 4:
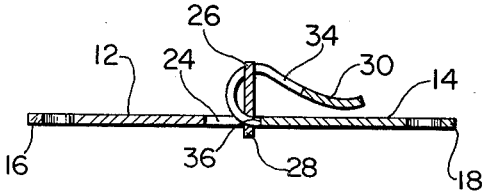
FIG. 4 is a section taken on line 4—4 of FIG. 3.

It is important to note that with the members 12 and 14 connected, as illustrated in FIGS. 1, 4 and 8, it is not possible to pull the members apart, since the interconnection of tongue 30 and flange 22 prevents this. By the same token, with the body members 12 and 14 connected and lying in the same plane, it is not possible to push the members toward each other to effect disconnection, because engagement of lug 28 with the front edge 36 of member 14 will prevent such movement, and even if the member 12 is tilted to the position illustrated in FIG. 7, in which position lug 28 is free to clear edge 36, the members still cannot be disconnected since lug 26 will engage the rear end of slot 34 to prevent such disconnection. It is only when member 12 has been swung to a substantially perpendicular disposition with respect to member 14 that the members can be slidably disconnected. It will thus be seen that the provision of the lugs 26, 28 and cooperating slot 34 is an extremely important feature of the present invention, because without these cooperating parts, it might be possible to separate the members 12 and 14 by forcing flange 22 outwardly beneath tongue 30. On the other hand, by providing lugs 26, 28 and cooperating slot 34, the members 12 and 14 can be disconnected only after they have been manipulated to the relative position illustrated in FIG. 6, which effectively eliminates the possibility of inadvertent separation between the members. It will be understood that even with the parts in the perpendicular disposition illustrated in FIG. 6, it is still necessary to slightly force the flange 22 outwardly beneath the terminal end of tongue 30, but the resilience of the latter easily permits this.

It has been found that connection and disconnection of the members 12 and 14 may be easily effected even when the fastener is located behind the neck of the wearer. The fastener 10 is relatively small and does not aesthetically detract from the article with which it is associated because, in use, all that is visible are the substantially flat surfaces of the members 12 and 14, as illustrated in FIG. 5. Also, as hereinbefore emphasized, once the members 12 and 14 have been connected, it is virtually impossible for them to become accidentally disconnected. The fastener 10 is easily made by automatic equipment and hence is economically feasible to manufacture, as well as being durable and long lasting in use.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A separable fastener adapted to releasably interconnect spaced ends of a flexible chain or the like, comprising a first plate-like body member having means at one end for receiving an end of the flexible chain, an upstanding flange extending laterally across its other end, there being a centrally positioned opening in said body adjacent said other end, said opening being bridged by said flange, said flange having centrally positioned upwardly and downwardly extending lugs thereon, and a second plate-like body member having means at one end for receiving the other end of the flexible chain, said second body member at its other end having an integral tongue extending away from said other end and then gently curving upwardly, rearwardly and downwardly and terminating in closely spaced relation to the upper surface of said second body member, said tongue being of lesser width than said opening, whereby when said first and second body members are releasably connected to each other, said tongue extends beneath said flange, upwardly through said opening, and then rearwardly over said flange, said tongue having an elongated slot extending from adjacent the beginning thereof and terminating intermediate said rearwardly and downwardly extending portion, said slot receiving therethrough the aforesaid oppositely extending lugs.

2. In the fastener of claim 1, the spaced relation between said terminal tongue portion and said upper surface being just slightly less than the thickness of said first plate-like body member.

3. In the fastener of claim 1, the distance between the ends of said upwardly and downwardly extending lugs being substantially equal to the maximum height of said reversely bent tongue.

4. The fastener of claim 1, further characterized in that said first and second body members are of sheet-metal construction.

5. The fastener of claim 4, further characterized in that said first and second body members are of substantially the same size and configuration.

6. The fastener of claim 5, further characterized in that said first and second body members taper arcuately inwardly from said other ends, said means for receiving the ends of said flexible chain comprising integrally formed eyes.

* * * * *